US006551133B2

(12) United States Patent
Tsukamoto et al.

(10) Patent No.: US 6,551,133 B2
(45) Date of Patent: Apr. 22, 2003

(54) BULB SOCKET

(75) Inventors: Hironori Tsukamoto, Shizuoka (JP); Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/158,263

(22) Filed: May 30, 2002

(65) Prior Publication Data

US 2002/0192985 A1 Dec. 19, 2002

(30) Foreign Application Priority Data

Jun. 13, 2001 (JP) ..... 2001-178033

(51) Int. Cl.[7] ..... H01R 13/73
(52) U.S. Cl. ..... 439/549
(58) Field of Search ..... 439/544, 547, 439/546, 548, 549, 545

(56) References Cited

U.S. PATENT DOCUMENTS 3,668,603 A * 6/1972 Burgess et al. ..... 439/101
4,076,358 A * 2/1978 Taormina et al. ..... 439/547
5,702,254 A * 12/1997 Whitson et al. ..... 439/168
5,879,186 A 3/1999 Harada
5,890,912 A * 4/1999 Jenkins ..... 439/547
5,895,295 A 4/1999 Harada

* cited by examiner

*Primary Examiner*—Lynn D. Feild
*Assistant Examiner*—Phuong Dinh
(74) *Attorney, Agent, or Firm*—Koda & Androlia

(57) ABSTRACT

A bulb socket including a socket body from a synthetic resin and a contact member made from a conductive metal material in the socket body. The socket body is integrally formed by: a socket main portion constructed by axially connecting a bulb fitting section and a power connecting section, a flange portion outwardly extended from the outer surface of the socket main portion, and engaging blocks formed on the socket main portion. A plurality of arc-shaped slits and arc-shaped resilient insulative contact strips are formed in the flange portion so as to extend along the outer peripheral surface of the bulb fitting section, and contact protrusions are formed on the arc-shaped resilient insulative contact strips so as to provide resiliency of the arc-shaped resilient insulative contact strips to enable more secure mounting of the bulb socket at a mounting hole in a panel.

12 Claims, 4 Drawing Sheets

BULB SOCKET

BACKGROUND OF THE INVENTION

1. Field of the Invention

The present invention relates to a bulb socket and more particularly to a bulb socket of a vehicular lamp.

2. Prior Art

Generally, a bulb socket is used to mount a bulb (a light source) to, for instance, a vehicular lighting fixture body so as to serve as a junction for power supply, and it has a socket body made from a synthetic resin.

The socket body typically includes a socket main portion, a flange portion, and engaging blocks. The socket main portion is constructed from a bulb fitting section and a power connecting section that are integrally formed in the axial direction. The flange portion extends radially from the outer surface of the socket main portion, and the engaging blocks also protrude from the outer surface of the socket main portion. The flange portion and the engaging blocks sandwich the edge portion of a socket mounting hole formed in the body of a vehicular lighting fixture, thus mounting the bulb socket to the vehicular lighting fixture.

In case the bulb socket needs a waterproof for the socket mounting hole, a packing made from a resilient material is generally superimposed on the front surface (i.e., the surface that faces the engaging blocks) of the flange portion of the socket body. The packing resiliently deforms between the edge portion of the socket mounting hole and the flange portion, thus preventing water from flowing into the socket mounting hole and also preventing the bulb socket from rattling.

If the bulb socket does not require waterproof for the socket mounting hole, no packing is used. As a result, it becomes necessary to find a measure to prevent the rattling of the bulb socket.

FIG. 8 shows such a measure used in a prior art bulb socket.

In this prior art bulb socket (h), resilient contact strips (d) and (e) are formed in the flange portion (b) that extends radially from the outer surface of a socket main portion (a), and each of the resilient contact strips (d) and (e) is spaced from the flange portion (b) by two slits (c). The resilient contact strips (d) and (e) have contact protrusions (g). The contact protrusions (g) are formed at tip ends of the contact strips (d) and (e) so as to protrude from the surfaces of the respective resilient contact strips (d) and (e), such surfaces facing the engaging blocks (f). In other words, the contact protrusions (g) are provided at the outer peripheral portions of the contact strips (d) and (e).

With the structure above, the edge portion of the socket mounting hole (not shown) is sandwiched by the engaging blocks (f) and the flange portion (b), and the contact protrusions (g) of the resilient contact strips (d) and (e) are brought into contact with the rear side of the edge portion of the socket mounting hole. In other words, the contact protrusions (g) contact one side of the edge portion that is the side opposite to the side which is in contact with the engaging blocks (f). As a result, the resilient contact strips (d) and (e) are deflected backwards, and resilient forces are applied to the resilient contact strips (d) and (e). The contact protrusions (g), as a result, come into resilient contact with the edge portion of the socket mounting hole, and the rattling of the bulb socket (h) is prevented.

In the above bulb socket (h), resilient forces caused by the deflection of the resilient contact strips (d) and (e) ensure that the bulb socket (h) be held while being prevented from rattling. However, the resilient contact strips (e) have a short length from their base ends to the contact protrusions (g); as a result, they do not have a sufficient flexibility. The problem caused is that a great force is required to mount the bulb socket (h).

More specifically, a bulb mounting portion in which the bulb socket (h) is to be mounted has a circular socket mounting hole and insertion notches formed in the edge of the socket mounting hole. When mounting the bulb socket (h), the engaging blocks (f) are inserted through the insertion notches, and the front part of the socket main portion (a) is inserted through the socket mounting hole to the depth of the flange portion (b). Keeping this state, the bulb socket is then turned as a whole in a predetermined direction until the engaging blocks (f) are located in the edge portion of the socket mounting hole so as to be at portions other than the insertion notches, so that the edge portion of the socket mounting hole is sandwiched in its axial direction (or form the front and rear sides of the edge portions) by the engaging blocks (f) and the flange portion (b). At this moment, the resilient contact strips (d) and (e) must be deflected in order to ensure that the engaging blocks (f) are located so that the surfaces of the engaging blocks (f) that face the flange portion (b) are coplanar with the front side surface of the edge portion of the socket mounting hole. Since the resilient contact strips (e) in the prior art bulb socket (h) lack flexibility, it requires a great force to obtain such a deflection in the strips e.i Thus, the bulb socket (h) is not easily mountable.

When the resilient contact strips (d) are designed to have a long length from their base ends to the contact protrusions (g), the resilient contact strips (d)l have a flexibility that is great enough to make it easy to mount the bulb socket (h). However, insufficient resilient forces obtained from the longer resilient contact strips (d) cause another problem. A sufficient mounting torque is not obtainable.

Furthermore, in the above prior art bulb socket, the resilient contact strips (d) and (e) are all in the shape of a cantilever spring. Accordingly, they are susceptible to breakage at their base ends if they receive a relatively large external force. This is another problem with the prior art bulb socket.

Moreover, so as for the resilient contact strips (e) to have a long length as that of the resilient contact strips (d), the slits (c) must be long enough to extend deep into the flange portion (b). The problem here is that the socket main portion (a) is under dimensional restrictions. Especially in the case of a bulb socket for a wedge-base bulb, a bulb holding portion (i) for holding the bulb cannot be shortened in the width direction of the base portion (see a bidirectional arrow A in FIG. 8) of the wedge-base bulb. For this reason, the relatively short resilient contact strips (e) can only be formed in opposed end portions in the width direction of the base portion, and the relatively long resilient contact strips (d) are thus formed in opposed end portions in a direction with the smaller dimension, namely, in the thickness direction of the base portion (see a bidirectional arrow B in FIG. 8). The bulb holding portion (i) of such a bulb socket takes an oblong shape when viewed from the front. Since the glass bulb in the bulb socket has a circular shape when viewed from the front, the bulb holding portion (i) and the glass bulb are visually incompatible with each other and cause a problem of a diminution in visual attractiveness. In particular, vehicular lighting fixtures in recent years are designed so that the reflector forms the light distribution pattern, and the lens for covering the front of the lamp functions merely as a cover for the lamp. For this reason, there is a growing tendency to employ a so-called transparent lens that has no lens step. When a lighting fixture employs such a transparent lens (front cover), the inside of the lighting fixture is distinctly visible from the outside. Accordingly, visual attractiveness is the prerequisite even to the components disposed inside the lighting fixture such as a bulb socket.

SUMMARY OF THE INVENTION

Accordingly, it is an object of the present invention to provide a bulb socket that has a socket body made from a synthetic resin and is provided with engaging blocks and a flange portion for sandwiching an edge of a socket mounting hole from its opposed sides and that is easily and reliably mountable and is durable and visually attractive.

The above object is accomplished by a unique structure for a vehicle lamp bulb socket of the present invention that comprises a socket body made from a synthetic resin and a contact member made from a conductive metal material and installed in the socket body; and in the bulb socket of the present invention, the socket body made from a synthetic resin is integrally formed of: a socket main portion constructed by axially connecting a substantially cylindrical bulb fitting section and a power connecting section, a flange portion radially extended from an outer surface of the socket main portion, and engaging blocks that, cooperating with the flange portion, sandwich an ledge portion of a socket mounting hole;

arc-shaped slits are formed at a plurality of positions in the flange portion so as to extend along an outer peripheral surface of the bulb fitting section;

arc-shaped resilient contact strips are formed in the flange portion so as to be spacedly located from the socket body with the arc-shaped slits in between; and contact protrusions are respectively formed on the arc-shaped resilient contact strips so as to face the engaging blocks.

In the above bulb socket of the present invention, the arc-shaped resilient contact strips are formed in the flange portion in a manner that each arc-shaped slit is between each contact strip and the socket main portion, and the contact protrusions are formed on the contact strips so as to be on the surface of the flange portion that faces the socket main portion. Thus, the contact protrusions come into resilient contact with the edge portion of the socket mounting hole due to the resilient force caused by deflection of the arc-shaped resilient contact strips, thus securely holding the bulb socket in the socket mounting hole.

Accordingly, the bulb, socket of the present invention makes it possible to provide the arc-shaped resilient contact strips with an arbitrary degree of flexibility by changing the length of the arc-shaped slits. Moreover, since the arc-shaped slits are formed along the outer peripheral surface of the bulb fitting section, the shape of the bulb fitting section remains unaffected no matter how long the arc-shaped slits are made. Therefore, the degree of freedom in designing the shape of the bulb fitting section increases, and it becomes possible to make the bulb fitting section visually attractive.

Furthermore, each of the arc-shaped resilient contact strips are formed so that both ends extend continuously from the rest of the flange portion and thus assumes the shape of a so-called two-side supported spring. Therefore, the arc-shaped resilient contact strips have advantages of greater flexibility and higher resistance to breakage as compared to those having the shape of a cantilever spring.

DETAILED DESCRIPTION OF THE INVENTION

Figure 1:
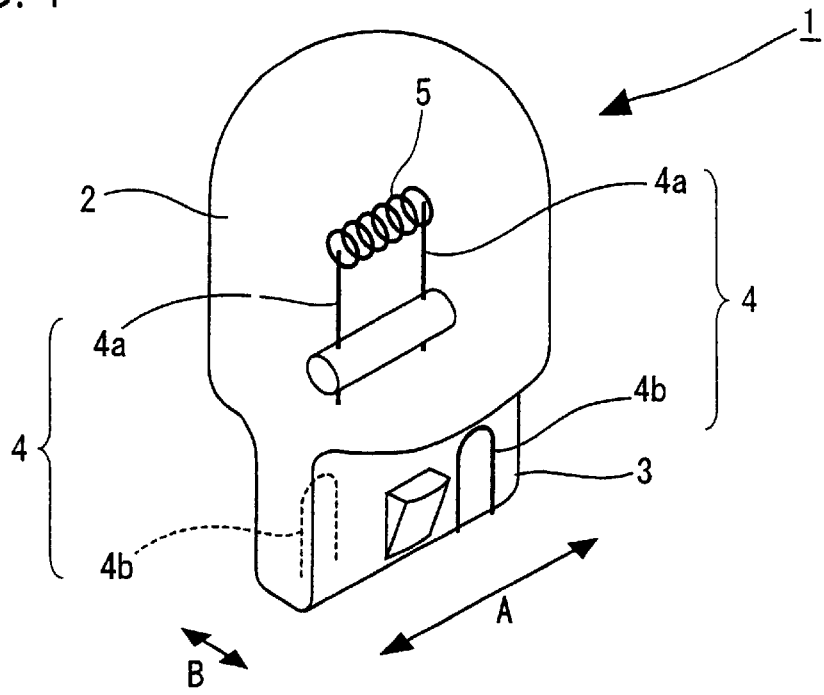
FIG. 1 is a schematic perspective view of an exemplary wedge-base bulb.

The bulb socket according to one embodiment of the present invention will be described hereinafter with reference to the accompanying drawings. In the embodiment shown in the drawings, the present invention is applied to a bulb socket for a wedge-base bulb.

A wedge-base bulb mounted in the bulb socket of the present invention is the one shown, as an example, in FIG. 1.

The wedge-base bulb 1 includes an envelope composed of a glass bulb 2 and a flat base portion 3 that is continuously formed to the glass bulb 2. Lead wires 4 are secured at their intermediate portions to the base portion 3 in an enclosed manner. A filament 5 is disposed in a tensioned state between the front ends of inner lead portions 4*a* of the lead wires 4. The inner lead portions 4*a* are located inside the glass bulb 2. The lead wires 4 have external portions 4*b* drawn out from the end of the base portion 3. The external portions 4*b* are the outside lead portions and folded toward the glass bulb 2 so as to extend along the side surfaces of the base portion 3. Two outside lead portions 4*b* extend along thee opposed side surfaces of the base portion 3.

Figure 2:
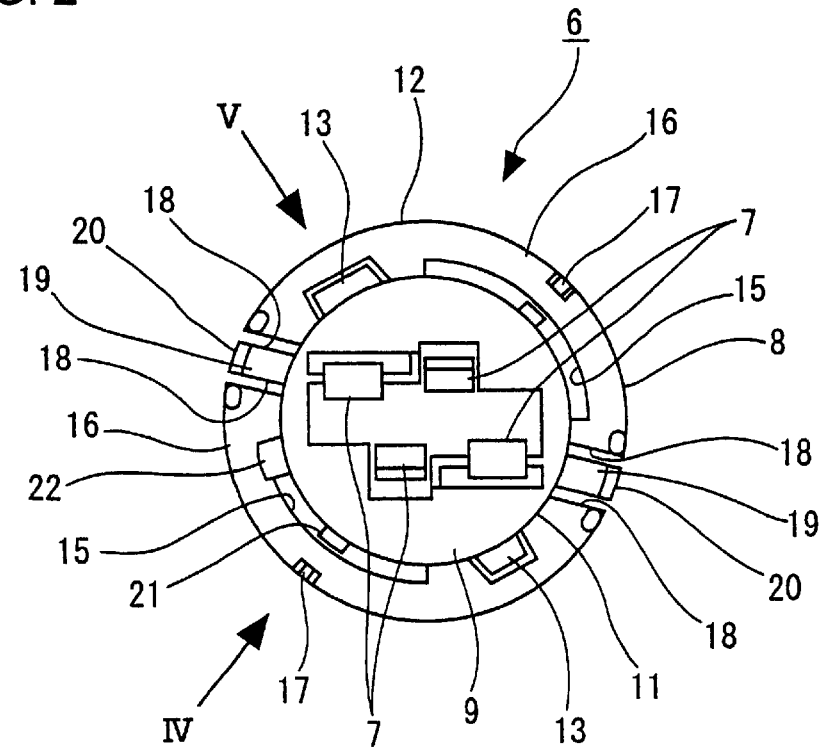
FIG. 2 is a front view of the bulb socket according to one embodiment of the present invention.
Figure 3:
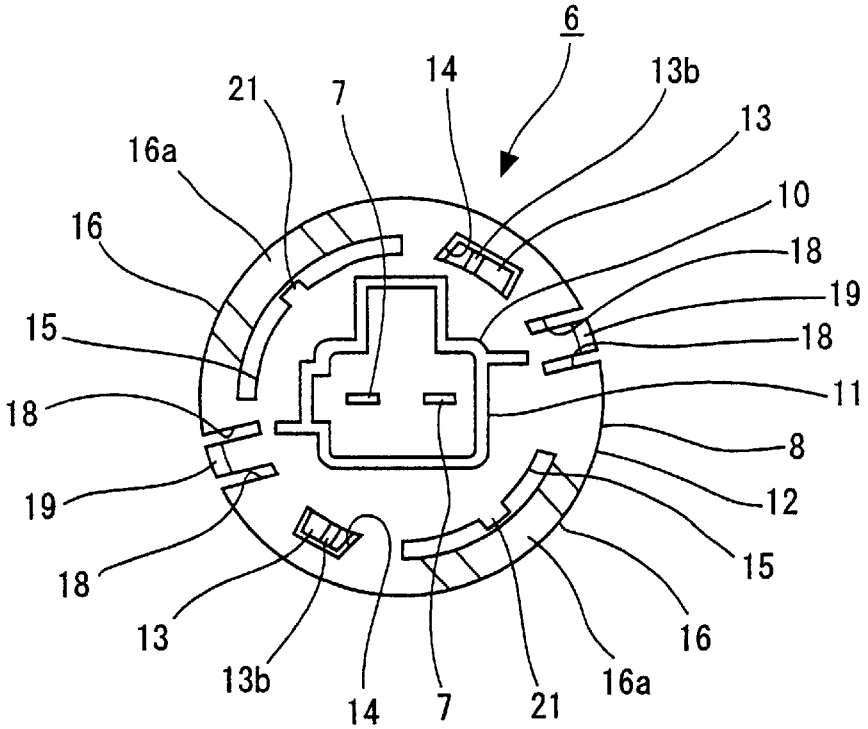
FIG. 3 is a rear view of the bulb socket.

This wedge-base bulb is mounted in the bulb socket 6 of the present invention, and the bulb socket 6 comprises a socket body 8 made from a synthetic resin and contact members 7 made from conductive metal plates and installed in the socket body 8 (see FIGS. 2 and 3).

The socket body 8 is substantially comprised of a socket main portion 11, a flange portion 12 and engaging blocks 13.

The socket main portion 11 includes a bulb fitting section 9 and a power connecting section 10 that are integrally formed with each other by being arranged in the longitudinal (or axial) direction. The bulb fitting section 9 is provided in the front, and the power connecting section 10 is in the back. The wedge-base bulb 1 is fitted in the bulb fitting section 9.

Figure 4:
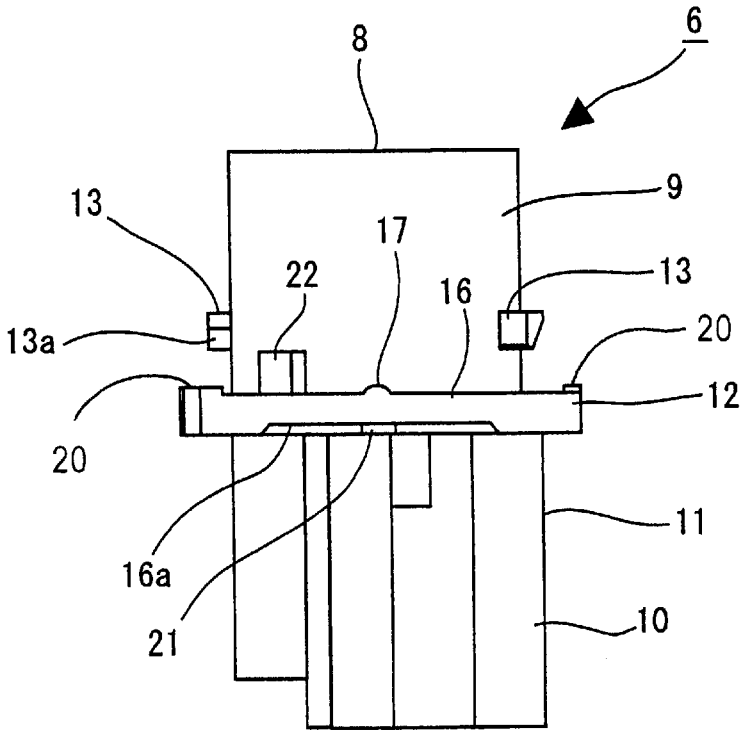
FIG. 4 is a view in the direction indicated by arrow IV in FIG. 2.

The bulb fitting section 9 is in a substantially circular cylindrical shape, and the power connecting section 10 has a substantially prismatic shape. The contact members 7 extend from the inside of the bulb fitting section 9 to the inside of the power connecting section 10. The contact members 7 hold the base portion 3 of the wedge-base bulb 1 in the bulb fitting section 9 and contact the outside lead portions 4*b* of the wedge-base bulb 1, thus serving as contact strips-to be connected to a power source in the power connecting section 10 (see FIGS. 2, 3 and 4). In other words, in the shown embodiment, the power connecting section 10 of the socket body 8 is a connector that connects the bulb socket to power source.

The flange portion 12 is formed so as to extend outward in the radial direction of the socket main portion 11A from a boundary area between the bulb fitting section 9 and the power connecting section 10 on an outer surface of the socket main portion 11. The flange portion 12 is integral with the socket main portion 11.

Figure 5:
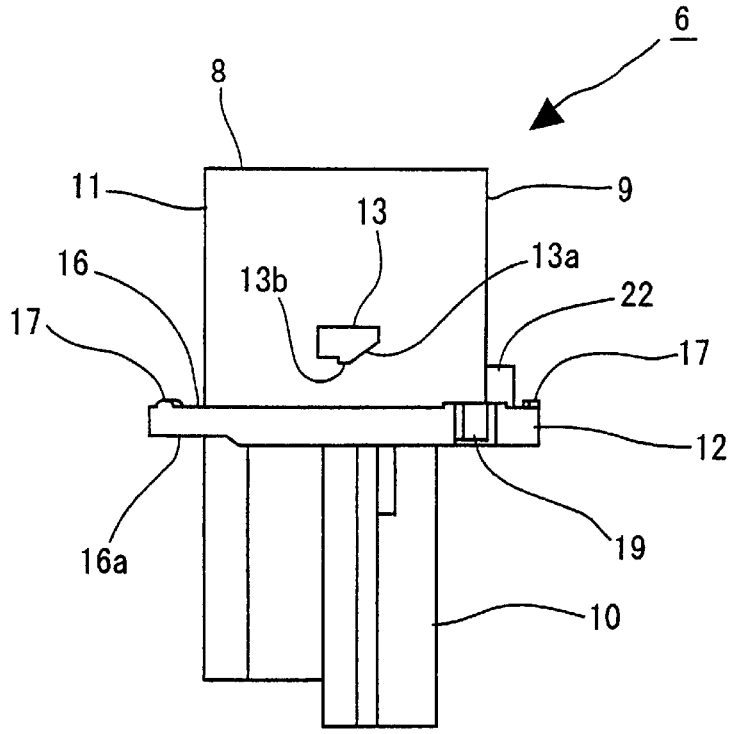
FIG. 5 is a view in the direction indicated by arrow V in FIG. 2.

The engaging blocks 13 are integrally formed on the bulb fitting section 9 so that they protrude (see FIG. 4) from the outer peripheral surface of the bulb fitting section 9. The engaging blocks 13 are provided at substantially diametrically opposed locations on the bulb fitting section as seen from FIG. 2 and are also spacedly separated from the flange portion 12 as seen from FIG. 4. Each engaging block 13 has a sloped end surface 13*a* and an engaging protrusion 13*b* as best seen from FIG. 5. The sloped end surface 13*a* is formed so as to face the flange portion 12, and it inclines further apart from the flange portion 12 in proportion to a decrease in distance from its front end. The engaging protrusion 13*b* is formed at the rear end (lower end in FIG. 5) of the sloped end surface 13*a* so as to face the flange portion 12.

Holes 14 (see FIG. 3) formed in the flange portion 12 are draw holes through which molds for forming the engaging blocks 13 are drawn out.

Arc-shaped slits 15 extending along an outer (peripheral) surface of the bulb fitting section 9 are formed in the flange portion 12 at diametrically opposed locations thereof so that the slits 15 do not overlap the draw holes 14.

The flange portion 12 has arc-shaped resilient contact strips 16 which are spacedly formed from the socket main portion 11 with the arc-shaped slits 15 in between. Contact protrusions (first contact protrusions) 17 are formed on the outer peripheral portions (see FIG. 2) of the arc-shaped resilient contact strips 16 so that the protrusions 17 protrude (see FIG. 4) from the front surfaces of the arc-shaped resilient contact: strips 16 that face the engaging blocks 13. Each of the contact protrusions 17 is located at an intermediate position (see FIG. 2) between two connecting sections that are at circumferentially both ends of each engaging block 13 and continuously formed from the bulb fitting section 9. Each arc-shaped resilient contact strip 16 is slightly dinted (see FIG. 4) in the portion 16*a* that is other than the circumferentially end portions. In other words, the portion 16 that is on the rear side of the contact strip 16 is formed thinner than other portions of the contact strip 16, so that the portion 16*a* makes a thin-wall portion 16*a*. As a result, the arc-shaped resilient contact strips 16 have considerable flexibility in the thin-wall portions 16*a*, namely, except in their end portions.

The flange portion 12 has resilient contact strips 19, each of which is formed between the arc-shaped resilient contact strips 16. More specifically, as seen from FIGS. 2 and 3, two pairs of slits 18 are formed in the flange portion 12 so as to extend outwardly from the outer peripheral surface of the bulb fitting section 9 to an outer peripheral edge of the flange portion 12. Each pair of the slits 18 separates the corresponding resilient contact strip 19 from the rest of the flange portion 12. Contact protrusion (second contact protrusions) 20 is formed so as to protrude frontward (or upward in FIG. 4) from each resilient contact strip 19 at the outermost end portion that corresponds to the outer peripheral edge of the flange portion 12.

Furthermore, as best seen from FIG. 2, posture correcting protrusions 21 are formed integrally on the outer peripheral surface of the bulb fitting section 9 of the socket main portion 11. Each posture correcting protrusion 21 is provided so as to correspond to a substantially circumferential central portion of each one of the arc-shaped slits 15.

The reference numeral 22 refers to a stopper protrusion. The stopper protrusion 22 is integrally formed on the outer surface of the bulb fitting section 9 of the socket main portion 11. As seen from FIGS. 2, 4 and 5, the stopper protrusion 22 is located so as not to overlap, in the axial direction of the socket main portion 11, with the arc-shaped slits 15, the slits 18, the resilient contact strips 19, or the engaging blocks 13. The stopper protrusion 22 is continuous at its rear end (or the lower end in FIG. 4) from the front surface (or the upper surface in FIG. 4) of the flange portion 12.

Figure 6:
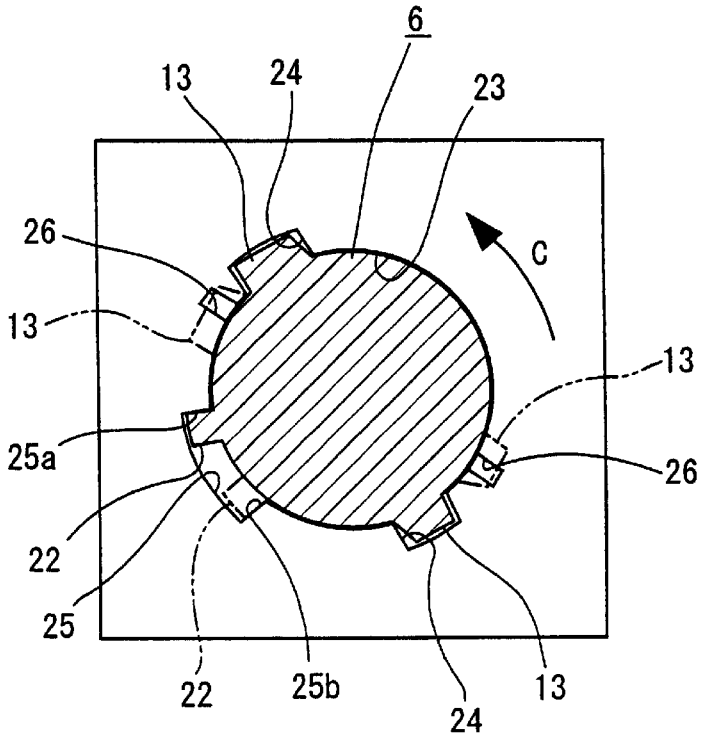
FIG. 6 is a front view of a mounting portion to which the bulb socket according to the present invention is mounted, the mounting portion including a socket mounting hole and being formed in a body of a vehicular lighting fixture.

FIG. 6 shows an example of a socket mounting hole 23 formed in a bulb socket mounting portion of a vehicular lighting fixture body.

The socket mounting hole 23 assumes a substantially circular shape, and it has two insert on notches 24 and a stopper notch 25. The insertion notches 24 are provided at substantially diametrically opposed locations and at different positions from the stopper notch 25. Furthermore, engaging recesses 26 are formed on the front surface of the edge portion of the socket mounting hole 23. Each of the engaging recesses 26 is formed slightly apart from one end of the nearby insertion notch 24.

The bulb socket 6 is mounted in the socket mounting hole 23 in the manner described below.

First, the front portion of the bulb socket 6 is brought into the socket mounting hole 23 from behind until the flange portion 12 comes into contact with the rear surface of the edge portion of the socket mounting hole 23. This insertion of the front portion of the bulb socket 6 into the socket mounting hole 23 is done with the engaging blocks 13 being passed through the insertion notches 24 and the stopper protrusion 22 being at one end 25*a* of the stopper notch 25 (the stopper protrusion 22 being shown by the solid line in FIG. 6).

When the engaging blocks 13 protrude almost entirely ahead of the socket mounting hole 23 on the front side of the bulb socket mounting portion, the bulb socket 6 is turned as shown by arrow C in FIG. 6. As a result, each of the sloped end surfaces 13*a* of the engaging blocks 13 comes into abutment on one end edge of the corresponding one of the insertion notches 24. Also, one end edge of each of the insertion notches 24 skids along the corresponding one of the sloped end surfaces 13*a* of the engaging blocks 13, whereby the bulb socket 6 moves slightly forward. Accordingly, the rear surfaces of the engaging blocks 13 come into contact with the front surface of the edge portion of the socket mounting hole 23. As far as the front surface of the flange portion 12, the arc-shaped resilient contact strips 16, and the resilient contact strips 19 of the bulb socket 6 are concerned, when the contact protrusions 17 and 20 are moved slightly forward from the state of contact with the rear surface of the edge portion of the socket mounting hole 23, the arc-shaped resilient contact strips 16 and the resilient contact strips 19 are, as described before, deflected slightly backward (or toward bottom in FIGS. 4 and 5). As a result, the contact protrusions 17 and 20 come into resilient contact with the rear side of the edge portion of the socket mounting hole 23.

Then, the bulb socket 6 is turned further in the direction of arrow C; as a result, the stopper protrusion 22 comes into abutment to the other end 25*b* of the stopper notch 25 (the stopper protrusion 22 being indicated by a double-dashed line in FIG. 6). Thus, the bulb socket 6 is not turned any further in the arrow C direction. At this moment, the engaging protrusions 13*b* of the engaging blocks 13 are engaged with the engaging recesses 26 formed in the front side of the edge portion of the socket mounting hole 23. Because of the engagement of the engaging protrusions 13*b* with the engaging recesses 26, an operator receives a feeling of clicking during the operation of mounting the bulb socket 6 and thereby is informed that the mounting operation has completed.

To disengage the engaging protrusions 13*b* from the engaging recesses 26, it is necessary, to turn the bulb socket 6 in the opposite direction from the arrow C by a force of a certain magnitude. Accordingly, any external force predictable in normal circumstances, such as a force resulting from vibrations of a running vehicle, cannot cause the bulb socket 6 to fall off from the socket mounting hole 23.

In the bulb socket 6 described above, the arc-shaped slits 15 are formed along the outer peripheral surface of the bulb fitting section 9 of the socket main portion 11 over a considerably extensive range and at diametrically opposed locations. For this reason, the bulb socket 6 might be set in an inclined posture unless it is inserted through the socket mounting hole 23 by applying a uniform force on the entire circumference. More specifically, if a greater forward pressing force is applied to the bulb socket 6 on the side of one of two arc-shaped slits 15 than on the side of the other arc-shaped slit 15, then the bulb socket 6 is pushed forward on the side of that one of the arc-shaped slits 15 than on the other arc-shaped slit 15. As a result, the bulb socket 6 would incline.

For this reason, the bulb socket 6 has the posture correcting protrusions 21; and these posture correcting protrusions 21 are formed on the outer peripheral surface of the bulb fitting section 9 and positionally correspond to the circumferential centers of the arc-shaped slits 15, and also they protrude into the arc-shaped slit 15. Accordingly, when the bulb socket 6 is inserted through the socket mounting hole 23, the posture correcting protrusions 21 come into abutment on the rear side of the edge portion of the socket mounting hole 23, and it becomes impossible to insert the bulb socket 6 any further into the socket mounting hole 23. Thus, the bulb socket 6 is mounted in the socket mounting hole 23 in a correct posture, namely, without any inclination The bulb socket 6 also has the resilient contact strips 19. The resilient contact strips 19 have the contact protrusions 20, and the contact protrusions 20 are located at both ends of an imaginary line that is perpendicular to an imaginary line that connects the contact protrusions 17 of the arc-shaped resilient strips 16. Accordingly, the contact protrusions 17 and 20 are arranged at substantially equal intervals in the circumferential direction and come into resilient contact with the rear side of, the edge portion of the socket mounting hole 23. The resilient contact strips 16 and 19 thus apply resilient forces in a well-balanced manner to the bulb socket 6 so as to ensure that the bulb socket 6 is stably mounted. Also, the posture of the bulb socket 6 is not destabilized easily.

The bulb socket 6 described above has the arc-shaped resilient contact strips 16. The contact strips 16 are formed so as to be spaced from the socket main portion 11 of the bulb socket 6 by the arc-shaped slits 15 that extend along the outer peripheral surface of the bulb fitting section 9. When the bulb socket 6 is mounted in the socket mounting hole 23, the contact strips 16 make a resilient contact with the rear side of the edge portion of the socket mounting hole 23 and keep the bulb socket 6 stabilized. Accordingly, by increasing the length of the arc-shaped slits 15, the arc-shaped resilient contact strips 16 have a greater flexibility. The bulb socket 6 thus has an advantage that the mounting can be done easily.

While having a great flexibility, each of the arc-shaped resilient contact strips 16 is connected at its end portions to the socket main portion 11 and takes a so-called two-side supported spring shape. Thus, the bulb socket 6 has an advantage of high resistance against breakage.

Furthermore, the slits 15 that form the arc-shaped resilient contact strips 16 extend along the outer peripheral surface of the bulb fitting section 9, and such slits 15 are not required to be deep into the socket main portion 11 in the radial direction. Accordingly, the bulb fitting section 9 can be formed in a cylindrical shape, and a lighting fixture that uses the bulb socket 6 can be made visually more attractive.

In other words, vehicular lighting fixtures in recent years are designed so that the light distribution pattern is formed by a reflector and a lens for covering the front area of a lamp functions merely as a cover. For this reason, there is a growing tendency to employ a so-called transparent lens that has no lens step. If a lighting fixture has a transparent lens (front cover) as described above, the inside of the lighting fixture is distinctly visible from the outside. If, however, a vehicular lighting fixture uses the bulb socket 6 of the present invention, what can be seen from the outside is the bulb fitting section 9 that has the same contour (circular shape) as the glass bulb 2 of the bulb 1 fitted to the lighting fixture. Thus, the vehicular lighting fixture does not cause a sense of incongruity to anyone looking at it. In other words, such a vehicular lighting fixture has an improved visual attractiveness as a whole.

Figure 7:
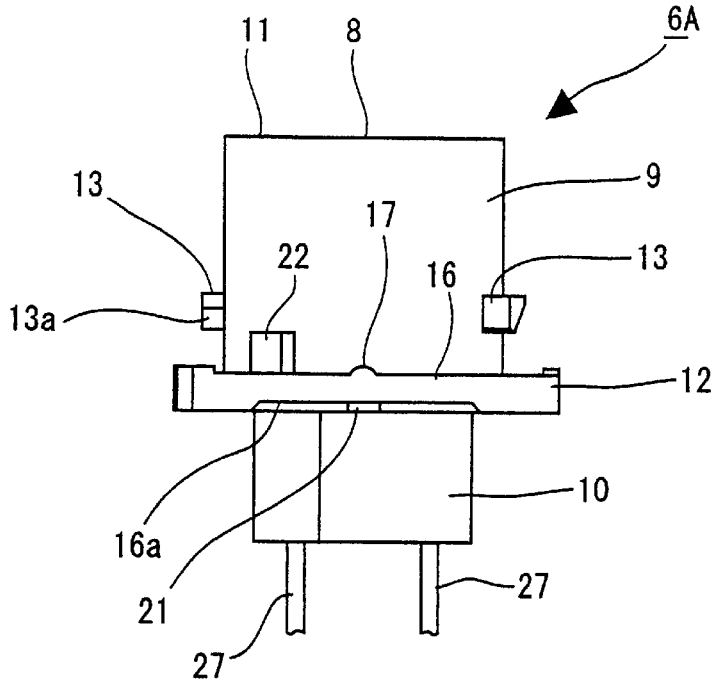
FIG. 7 is a side view, of a modified example of the bulb socket of the present invention.
Figure 8:
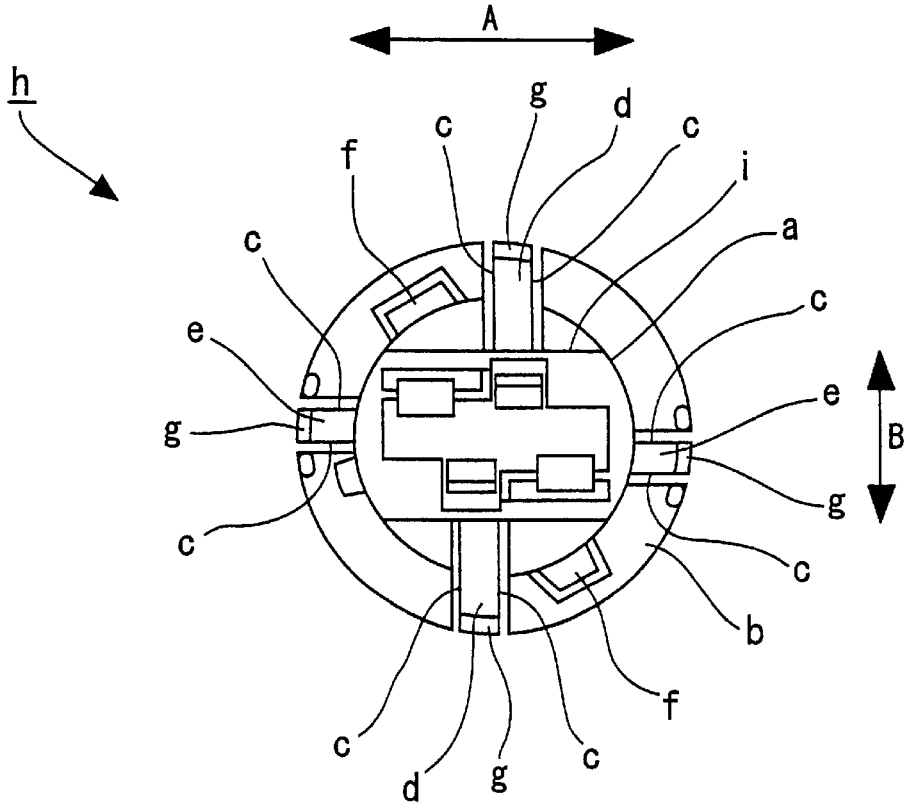
FIG. 8 is a front view of a prior art bulb socket.

In the above embodiment, the power connecting section 10 is a connector portion. However, as seen in the bulb socket 6A shown in FIG. 7, the contact members 7 can be connected to cords 27 in the power connecting section 10, so that the contact members 7 are connected to a power source via the cords 27. The bulb socket 6A of FIG. 7 is identical in construction to the bulb socket 6 as far as the portions other than the power connecting section 10 are concerned.

In the above embodiments, the present invention is described with reference to a bulb socket to which a wedge-base bulb is secured. However, the scope of application of the present invention is not limited to a bulb socket for, wedge-base bulbs. The present invention is indeed applicable to a bulb socket to which a bulb having a metal base, for instance, is fitted.

It should be also noted that the shapes and structures of all the components described in the above embodiment are merely examples, and the technical scope of the present invention should not be construed narrowly on the ground of such shapes and structures.

As is apparent from the foregoing description, the bulb socket of the present invention comprises the socket body made from a synthetic resin and the contact member made from a conductive metal material and installed in the socket body. The socket body is integrally formed by a socket main portion constructed by axially connecting a generally cylindrical bulb fitting section and a power connecting section, a flange portion extended outward from the outer surface of the socket main portion, and engaging blocks formed on the socket main portion so as to sandwich the edge portion of a socket mounting hole with a cooperation with the flange portion. Also, arc-shaped slits are formed in the flange portion at a plurality of positions so as to extend along the outer peripheral surface of the bulb fitting section. In addition, utilizing the arc-shaped slits, arc-shaped resilient contact strips are formed in the flange portion; and the contact protrusions are formed on the arc-shaped resilient contact strips so that the contact protrusions are on the surfaces of the arc-shaped resilient contact strips that face the engaging blocks.

Accordingly, in the bulb socket of the present invention, the arc-shaped resilient contact strips are provided spacedly on the socket body with the arc-shaped slits in between; and on the arc-shaped resilient contact strips, the contact protrusions are formed. The contact protrusions thus come into resilient contact with the edge portion of the socket mounting hole due to the resilient forces caused by deflection of the arc-shaped resilient contact strips, and the bulb socket is set in the socket mounting hole in a stable fashion. Accordingly, the arc-shaped resilient contact strips can be formed so as to have an arbitrary degree of flexibility by way of selecting an appropriate length for the arc-shaped slits.

Moreover, since the arc-shaped slits are formed along the outer peripheral surface of the bulb fitting section, the shape of the bulb fitting section is unaffected no matter how long the arc-shaped slits are made. Therefore, the degree of freedom in designing the shape of the bulb fitting section is high, and the bulb fitting section can be formed visually attractive.

In addition, each of the arc-shaped resilient contact strips has its end portions continuously formed from the rest of the flange portion and thus assumes the shape of a so-called two-side supported spring. Therefore, the advantage of the arc-shaped resilient contact strips is that they have of a greater flexibility and higher resistance to breakage compared to those of a cantilever spring shape.

In the present invention, the contact protrusions are respectively formed substantially at circumferential centers of the corresponding arc-shaped resilient contact strips. The resilient forces are thus applied to the contact protrusions uniformly in the circumferential direction. The resilient forces are thus applied parallel to the direction in:which the bulb socket is mounted, and the bulb socket is mounted stably.

In the present invention, each of the arc-shaped resilient contact strips is made thinner at least in its area other than its both end portions compared to the rest of the flange portion. The arc-shaped resilient contact strips thus have greater flexibility and higher resistance to breakage. Also, a desired resilient force can be obtained by taking different thickness for the thinner part of the contact strips.

Furthermore, in the present invention, each resilient contact strip, which is spaced from the rest of the flange portion by two slits, is formed between two arc-shaped slits formed in the flange portion, and the contact protrusion is formed in the resilient contact strip so as to be on the surface that faces the engaging block. The contact protrusion, in addition to the contact protrusions of the arc-shaped resilient contact strips, comes into resilient contact with the rear side of the edge portion of the socket mounting hole. As a result, resilient forces are applied to the rear side of the edge portion of the socket mounting hole in a well-balanced manner.

Furthermore, in the present invention, the posture correcting protrusions protrude from the outer surface of the socket main portion into the arc-shaped slits. Therefore, in the process of mounting the bulb socket in the socket mounting hole, the posture correcting protrusions come into abutment to the rear side of the edge portion of the socket mounting hole, and thus bulb socket is prevented from being inclined.

What is claimed is:

1. A bulb socket comprising a socket body made from a synthetic resin and a contact member made from a conductive metal material and installed in said socket body, wherein said socket body is integrally formed of:

a socket main portion comprised of a substantially cylindrical bulb fitting section and a power connecting section which are continuously formed in an axial direction thereof, a flange portion radially extending from an outer surface of said socket main portion, and engaging blocks that cooperating wit said flange portion, sandwich an edge portion of a socket mounting hole; and said socket body further comprises:

arc-shaped slits formed at a plurality of positions in said flange portion so as to extend along an outer peripheral surface of said bulb fitting section;

arc-shaped resilient contact strips respectively formed in said flange portion so as to be spacedly located from said socket body with said arc-shaped slits in between;

first contact protrusions respectively formed on said arc-shaped resilient contact strips so as to face said engaging blocks; and wherein each one of said first contact protrusions is formed substantially at a circumferential center of each one of said arc-shaped resilient contact strips.

2. The bulb socket according to claim 1, wherein each of said arc-shaped resilient contact strips is made thinner, compared to said flange portion, at least at a region thereof that is other than end portions thereof.

3. The bulb socket according to claim 1, further comprising:

resilient contact strips respectively formed in said flange portion and spacedly separated from said flange portion by two slits, and second contact protrusions formed respectively on surfaces of said resilient contact strips that face said engaging block.

4. The bulb socket according to claim 1, further comprising posture correcting protrusions that protrude from said outer surface of said socket main portion into said arc-shaped slits.

5. The bulb socket according to claim 2, further comprising:

resilient contact strips respectively formed in said flange portion and spacedly separated from said flange portion by two slits, and second contact protrusions formed respectively on surfaces of said resilient contact strips that face said engaging block.

6. The bulb socket according to claim 2, further comprising posture correcting protrusion s that protrude from said outer surface of said socket main portion into said arc-shaped slits.

7. The bulb socket according to claim 3, further comprising posture correcting protrusions that protrude from said outer surface of said socket main portion into said arc-shaped slits.

8. The bulb socket according to claim 5, further comprising posture correcting protrusions that protrude from said outer surface of said socket main portion into said arc-shaped slits.

9. A bulb socket comprising a socket body made from a synthetic resin and a contact member made from a conductive metal material and installed in said socket body, wherein said socket body is integrally formed of:

a socket main portion comprised of a substantially cylindrical bulb fitting section and a power connecting section which are continuously formed in an axial direction thereof, a flange portion radially extending from an outer surface of said socket main portion, and engaging blocks that, cooperating with said flange portion, sandwich an edge portion of a socket mounting hole; and said socket body further comprises:

arc-shaped slits formed at a plurality of positions in said flange portion so as to extend along an outer peripheral surface of said bulb fitting section;

arc-shaped resilient contact strips respectively formed in said flange portion so as to be spacedly located from said socket body with said arc-shaped slits in between;

first contact protrusions respectively formed on said arc-shaped resilient contact strips so as to face said engaging blocks; and further comprising posture correcting protrusions that protrude from said outer surface of said socket main portion into said arc-shaped slits.

10. A bulb socket comprising a socket body made from a synthetic resin and a contact member made from a conductive metal material and installed in said socket body, wherein said socket body is integrally formed of:

a socket main portion comprised of a substantially cylindrical bulb fitting section and a power connecting section which are continuously formed in an axial direction thereof, a flange portion radially extending an outer surface of said socket main portion, and engaging blocks that, cooperating with said flange portion, sandwich an edge portion of a socket mounting hole; and said socket body further comprises:

arc-shaped slits formed at a plurality of positions in said flange portion so as to extend along an outer peripheral surface of said bulb fitting section;

arc-shaped resilient contact strips respectively formed in said flange portion so as to be spacedly located from said socket body with said arc-shaped slits in between;

first contact protrusions respectively formed on said arc-shaped resilient contact strips so as to face said engaging blocks; and further comprising posture corrcting protrusions that protrude from said outer surface of said socket main portion into said arc-shaped slits; and wherein each of said arc-shaped resilient contact strips is made thinner, compared to said flange portion, at least at a region thereof that is other than end portions thereof.

11. A bulb socket comprising a socket body made from a synthetic resin and a contact member made from a conductive metal material and installed in said socket body, wherein said socket body is integrally formed of:

socket main portion comprised of a substantially cylindrical bulb fitting section and a power connecting section which are continuously formed in an axial direction thereof, a flange portion radially extending from an outer surface of said socket main portion, and engaging blocks that, cooperating with said flange portion, sandwich an edge portion of a socket mounting hole; and said socket body further comprises:

arc-shaped slits formed at a plurality of positions in said flange portion so as to extend along an outer peripheral surface of said bulb fitting section;

arc-shaped resilient contact strips respectively formed in said flange portion so as to be spacedly located from said socket body with said arc-shaped slits in between;

first contact protrusions respectively formed on said arc-shaped resilient contact strips so as to face said engaging blocks; and further comprising posture correcting protrusions that protrude from said outer surface of said socket main portion into said arc-shaped slits; and resilient contact strips respectively formed in said flange portion so as to be spacedly separated from said flange portion with two slits, and second contact protrusions formed respectively on surfaces of said resilient contact strips that face said engaging block.

12. A bulb socket comprising a socket body made from a synthetic resin and a contact member made from a conductive metal material and installed in said socket body, wherein said socket body is integrally formed of:

a socket main portion comprised of a substantially cylindrical bulb fitting section and a power connecting section which are continuously formed in an axial direction thereof, a flange portion radially extending from an outer surface of said socket main portion, and engaging blocks that, cooperating with said flange portion, sandwich an edge portion of a, socket mounting hole; and said socket body further comprises:

arc-shaped slits formed at a plurality of positions in said flange portion so as to extend along an outer peripheral surface of said bulb fitting section;

arc-shaped resilient contact strips respectively formed in said flange portion so as to be spacedly located from said socket body with said arc-shaped slits in between;

first contact protrusions respectively formed on said arc-shaped resilient contact strips so as to face said engaging blocks; and further comprising posture correcting protrusions that protrude from said outer surface of said socket main portion into said arc-shaped slits;

resilient contact strips respectively formed in said flange portion so as to be spacedly separated from said flange portion with two slits; and second contact protrusions formed respectively on surfaces of said resilient contact strips that face said engaging blocks.

* * * * *